US006641067B2

(12) United States Patent
Nakazato

(10) Patent No.: US 6,641,067 B2
(45) Date of Patent: Nov. 4, 2003

(54) CRUSHER

(75) Inventor: Hiroyoshi Nakazato, Namerikawa (JP)

(73) Assignees: Shinwa Industrial Co., Ltd., Toyama (JP); Frontier Co., Ltd., Toyama (JP)

( * ) Notice: Subject to any disclaimer, the term of this patent is extended or adjusted under 35 U.S.C. 154(b) by 9 days.

(21) Appl. No.: 09/859,783

(22) Filed: May 16, 2001

(65) Prior Publication Data

US 2001/0048041 A1 Dec. 6, 2001

(30) Foreign Application Priority Data

May 30, 2000 (JP) ..... 2000-159402

(51) Int. Cl.[7] ..... B02C 19/00
(52) U.S. Cl. ..... 241/65; 241/285.2
(58) Field of Search ..... 241/284, 26, 5, 241/39, 65, 285.2

(56) References Cited

U.S. PATENT DOCUMENTS 1,756,254 A * 4/1930 Lykken ..... 241/40
1,931,555 A * 10/1933 Mosley ..... 241/275
2,539,775 A * 1/1951 Gordon ..... 241/188.2
4,176,798 A * 12/1979 Talbott et al. ..... 241/39
4,378,911 A * 4/1983 Adams et al. ..... 241/187

FOREIGN PATENT DOCUMENTS

JP 10-113566 5/1998
JP 2000-61340 * 8/1998
JP 11-300224 * 11/1999

* cited by examiner

*Primary Examiner*—Mark Rosenbaum
(74) *Attorney, Agent, or Firm*—Merchant & Gould P.C.

(57) ABSTRACT

A supplying inlet is placed at a position where materials to be crushed supplying direction is offset on the forward direction side of a rotating direction relative to the rotating center of the rotation wing on the supplying side and a discharge outlet is placed at a position where crushed product discharge direction is offset on the forward direction side of a rotating direction relative to the rotating center of the rotation wing on the discharge side; and a casing on supplying side and a casing on discharge side are fitted so as to be separable from each other. Thereby retention time in the casing of crushed product is short, heat degeneration is little, and a good product can be obtained; and maintenance and cleaning are made easier.

12 Claims, 8 Drawing Sheets

CRUSHER

FIELD OF THE INVENTION

The present invention relates to a crusher to crush agricultural objects, mineral objects, medical supplies, or other materials to be crushed, and more particularly to fine powders supplied to a crushing chamber provided between a pair of rotation wings in the casing.

BACKGROUND OF THE INVENTION

Conventionally, a crusher which rotates a first rotor and a second rotor in a casing, supplies materials to be crushed to a crushing chamber provided between the first rotor and the second rotor, and crushes materials to be crushed by friction to fine powders is already known, (Refer to Japanese publication No. H7-4553, Japanese publication No. H7-83840, Japanese Laid open publication No. H11-300224, Japanese Laid open publication No. 2000-61340). This conventional crusher has a configuration such that the first rotor and the second rotor are housed in one casing, and a supplying inlet of the materials to be crushed and a discharge outlet of the crushed or powdered objects are also provided in this casing. After the materials to be crushed supplied to the supplying inlet are absorbed in the casing by air current caused by rotation of the rotor and powdered by friction between the first rotor and the second rotor, the powdered objects are discharged from the outlet.

However, there are problems with the conventional crushers. That is, there is a problem that since the crusher absorbs and discharges the crushed objects by only circulation of air caused by rotation of the first rotor and the second rotor, the configuration does not easily discharge the crushed objects, so_that retention time in the casing of the crushed objects is long and thereby heat deformation of the obtained products is easily generated.

Further, since the configuration of the conventional crusher is a configuration in which the first rotor and the second rotor are housed in one casing, the casing is fixed to a rotor. Thereby, maintenance or internal cleaning is troublesome. Furthermore, there is a problem that since the inside of the casing in the conventional crusher is easily worn by frictional contact with the materials to be crushed, maintenance to repair the crusher is necessary; and in a case of wearing, remaking the casing itself and changing it are necessary, and this working is complex and takes long time.

And there is a problem that in a case of changing a distance between the rotors according to the kind of materials to be crushed or grading of the crushed object, the crusher having a configuration of Japanese Laid Open publication No. 2000-61340 has to be disassembled by unlatching the bolt of a casing body and this working is very troublesome, it takes a long time; and the distance is not easily changed.

SUMMARY OF THE INVENTION

This invention has been made to solve the above problems, and it is therefore a first object of the invention to provide a crusher in which, by improving a supplying inlet and a discharge outlet, materials to be crushed are smoothly supplied and a crushed product is smoothly discharged; retention time in the casing of the crushed product is shortened; heat deformation is little; and crushed product with desired grading is obtained.

A second object of the present invention is to provide a crusher, in which countermeasure against wearing of the casing can be taken; distance between rotation wings cannot be changed easily; and further working effect of maintenance and cleaning is increased by being easily capable of separating a casing on the supplying side and a casing on the discharge side in a short time.

Another object of the present invention is to provide a crusher for introducing materials to be crushed from a supplying inlet into a crushing chamber formed between a rotation wing on the supplying side and a rotation wing on the discharge side with each set to a rotating shaft, and to rotate to face each other in a casing on the supplying side and a casing on the discharge side; and for discharging a crushed product crushed by mutual friction of materials to be crushed from a discharge outlet, in which the supplying inlet is placed at a position where the materials to be crushed supplying direction is offset on the forward direction side of the rotating direction relative to the rotating center of the rotation wing on the supplying side; and the discharge outlet is placed at a position where the crushed product discharge direction is offset on the forward direction side of the rotating direction relative to the rotating center of the rotation wing on the discharge side.

With such configuration, once the materials to be crushed are supplied from the supplying inlet, the materials to be crushed are immediately rolled along the rotating direction of the rotating shaft, passed through the rotation wing, absorbed in the crushing chamber, crushed by friction mutually developed, and then the fine powdered product is discharged from the discharge outlet by using the rotating direction of the rotating shaft.

Another object of the present invention is to provide a crusher for introducing materials to be crushed from a supplying inlet into a crushing chamber formed between a rotation wing on the supplying side and a rotation wing on the discharge side, each being set to a rotating shaft, and to rotate in a casing on the supplying side and a casing on the discharge side; and for discharging a crushed product crushed by mutual friction of materials to be crushed, in which the casing on the supplying side in which the rotation wing on the supplying side is incorporated; and the casing on the discharge side in which the rotation wing on the discharge side is incorporated are detachably fit at the position of the crushing chamber. With such configuration, changing both casings when they are worn is available and changing interval of both rotation wings is easily available, and further maintenance or cleaning of the inside of a casing is available.

Another object of the present invention is to provide a crusher, in which movement means to move via a movement guide is provided such that the casing on the supplying side and the casing on the discharge side are fitted to and are detachable from each other. With such configuration, once the fitted portion of both is unlatched and one of the casing on the supplying side or the casing on the discharge side is moved back by the movement means, crush working becomes available again when the casing on the supplying side and the casing on the discharge side are moved by the movement means and again fitted together.

Another object of the present invention is to provide a crusher, in which a cylindrical intermediate casing is detachably fitted between the casing on the supplying side and the casing on the discharge side. By such configuration, the interval of both rotation wings can be easily adjusted.

Another object of the present invention is to provide a crusher, in which spacer rings are detachably fitted either or both between the intermediate casing and the casing on the supplying side, or/and between the intermediate casing and the casing on the discharge side. With such configuration, the spacer ring can be easily changed when adjusting interval dimension of both rotation wings by changing thickness of the spacer ring.

Another object of the present invention is to provide a crusher, in which the inner circumference of the spacer ring is arranged at a position so as to face the outer circumference of the rotation wing on the supplying side in the casing on the supplying side or the rotation wing on the discharge side in the casing on the discharge side. With such configuration, material or hardness of the spacer ring can be easily changed according to the materials to be crushed. And material or hardness of the spacer ring can be easily changed at the time of wearing of the spacer-ring.

Another object of the present invention is to provide a crusher, in which a jacket for cooling is provided on the outside of the casing on the discharge side, the casing on the supplying side, and the crushing chamber. With such configuration, the casing on the supplying side, the casing on the discharge side and the crushing chamber can be cooled by introducing cooling medium such as cooling liquid or cooling gas into the jacket.

Another object of the present invention is to provide a crusher, in which spacer collars are provided at the rotating shaft; and the rotation wing on the supplying side and the rotation wing on the discharge side set to the rotating shaft are respectively contacted/attached to one end of the spacer collars. With such configuration, a gap between the rotation wing and the casing can be easily changed by moving the position of the rotation wing, which contacts/attaches to this when the length of the spacer collar is changed. Therefore, gaps (G1, G2) can be easily changed without changing the dimension of the outer diameter of both rotation wings.

Another object of the present invention is to provide a crusher, in which lock means is included, which is capable of fixing at a position where the casing on the supplying side or/and the casing on the discharge, side is/are moved along the movement guide. With such configuration, the casing on the supplying side or the casing on the discharge side can be moved along the movement guide by the movement means and fixed at a predetermined position by the lock means. The casings can easily be detached and fitted together in a short time without use of a tool.

The above and other objects, features, and advantages of the invention will become more apparent from the following description when taken in conjunction with the accompanying drawings.

DESCRIPTION OF THE PREFERRED EMBODIMENT

Below, the embodiment of a crusher according to the present invention is described with reference to the drawings in detail.

Figure 1A:
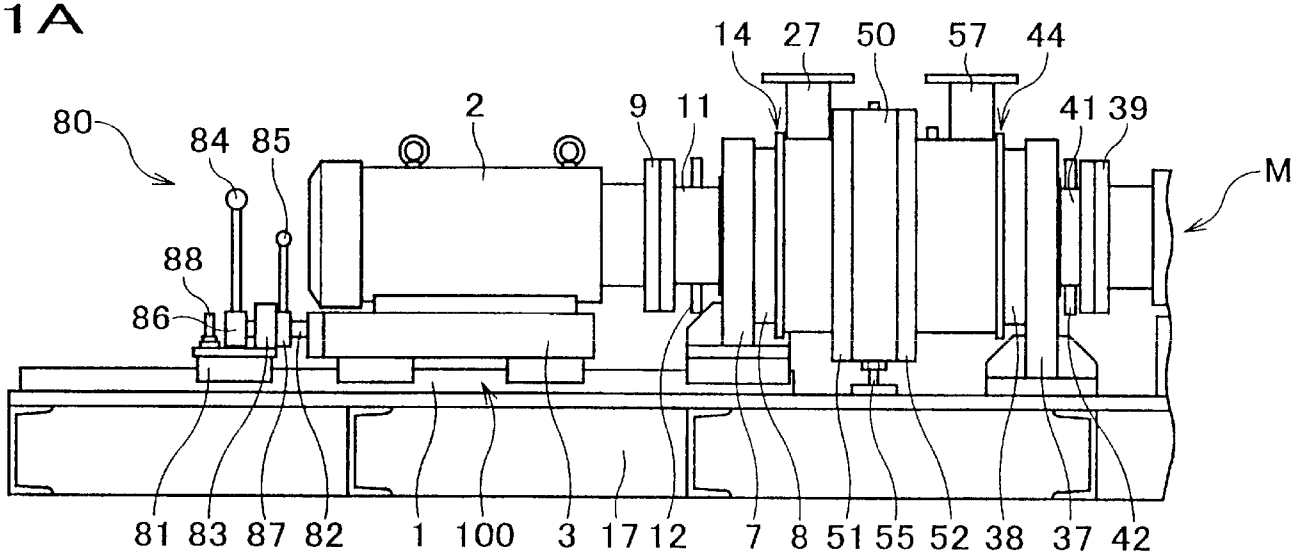
FIG. 1A is a side view showing one embodiment according to the present invention with casings fitted together.
Figure 1B:
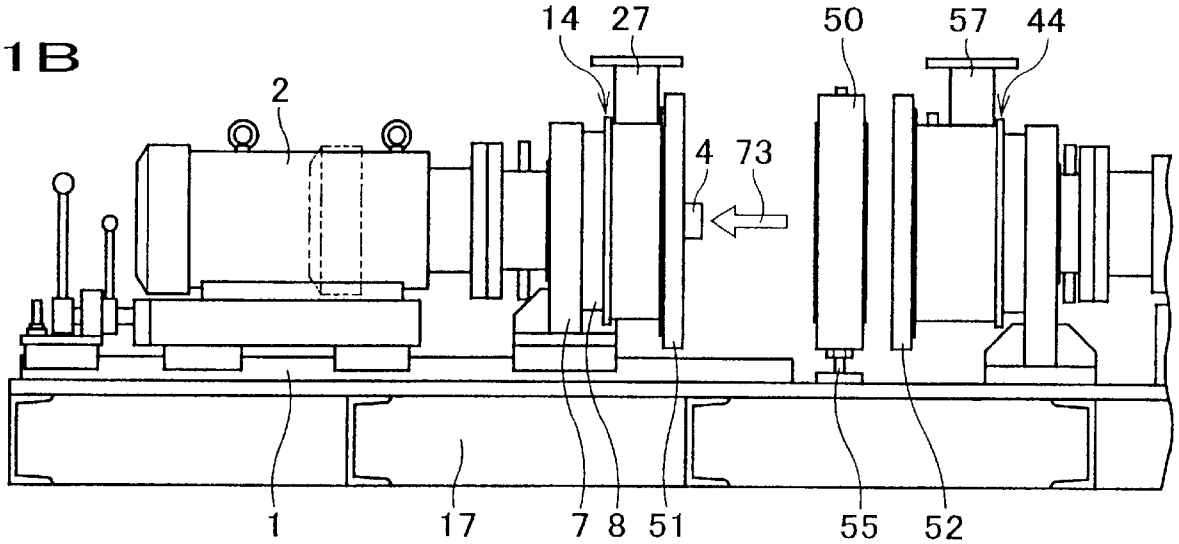
FIG. 1B is similar to FIG. 1A with casings separated.
Figure 4:
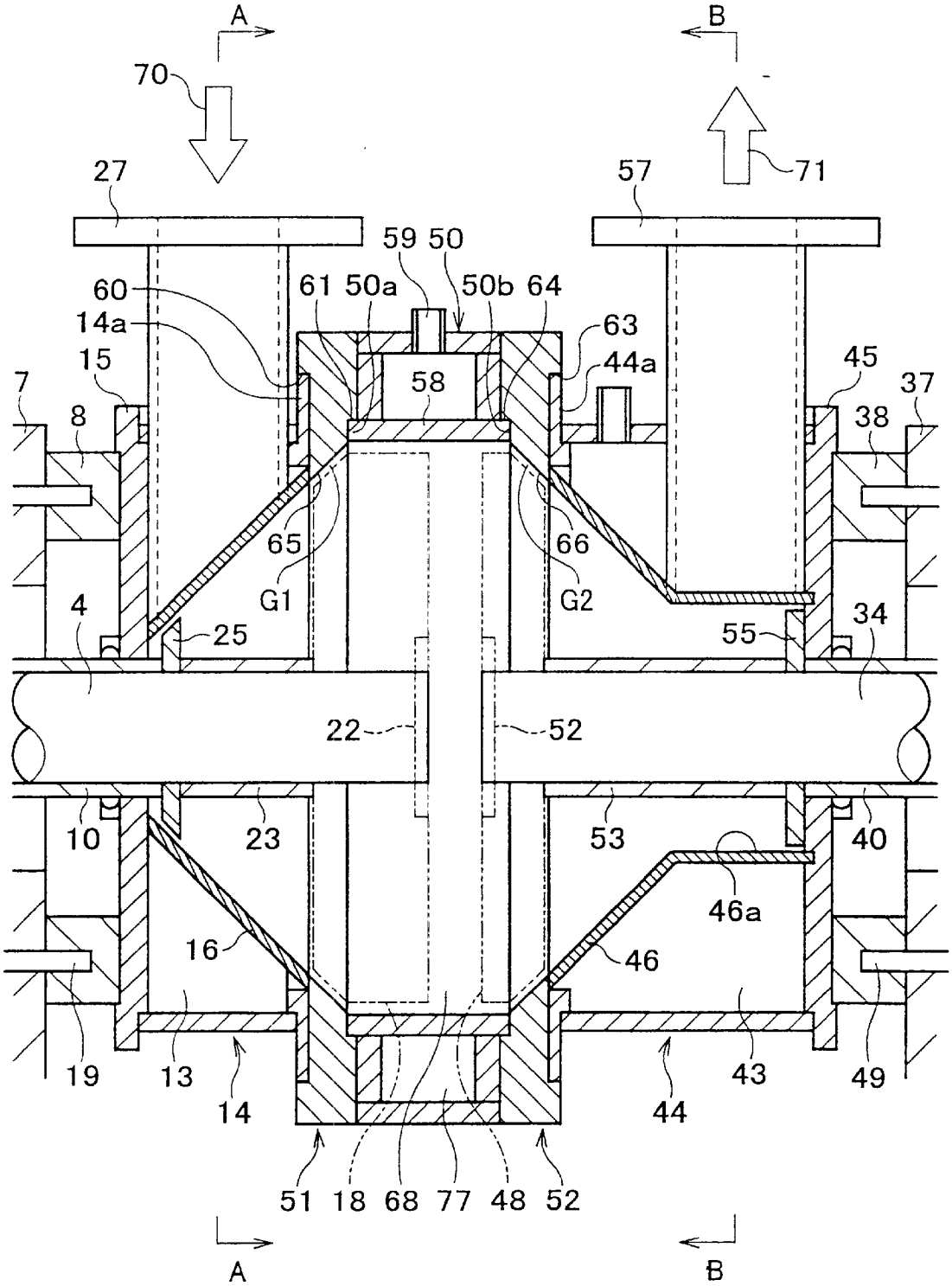
FIG. 4 is an enlarged sectional view with casings fitted together according to the present invention.
Figure 5:
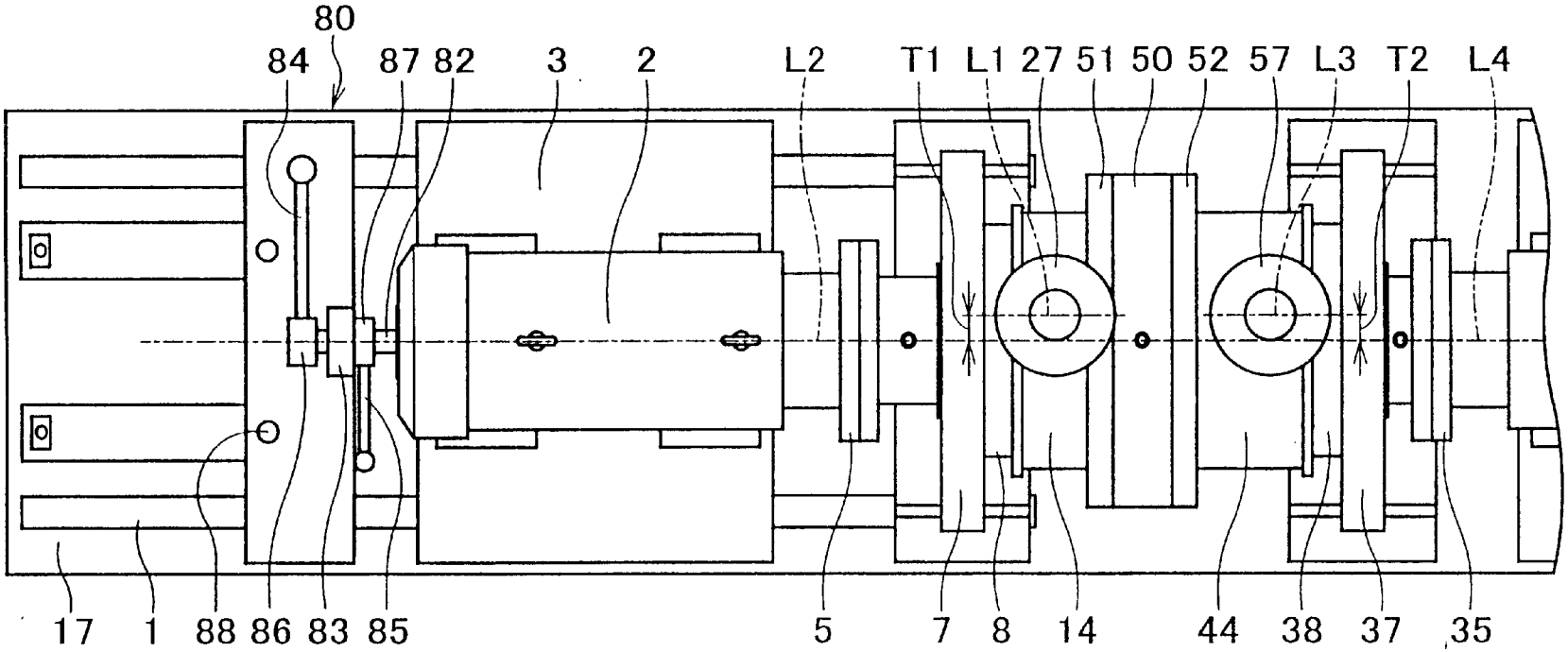
FIG. 5 is a plan view of a crusher according to the present invention.

A crusher M of the present Embodiment as shown in FIGS. 1A, 1B and 4 is configured to have a casing 14 on supplying side, a casing 44 on discharge side, a rotation wing 18 on supplying side set to a rotating shaft 4, a rotation wing 48 on discharge side set to a rotating shaft 34, an intermediate casing 50 and spacer rings 51, 52 fit between casing 14 on supplying side and a casing 44 on discharge side, a movement means 100 to move the casing 14 on supplying side and the casing 44 on discharge side, and lock means 80 which is capable of fixing movement means 100 at a position.

Figure 2:
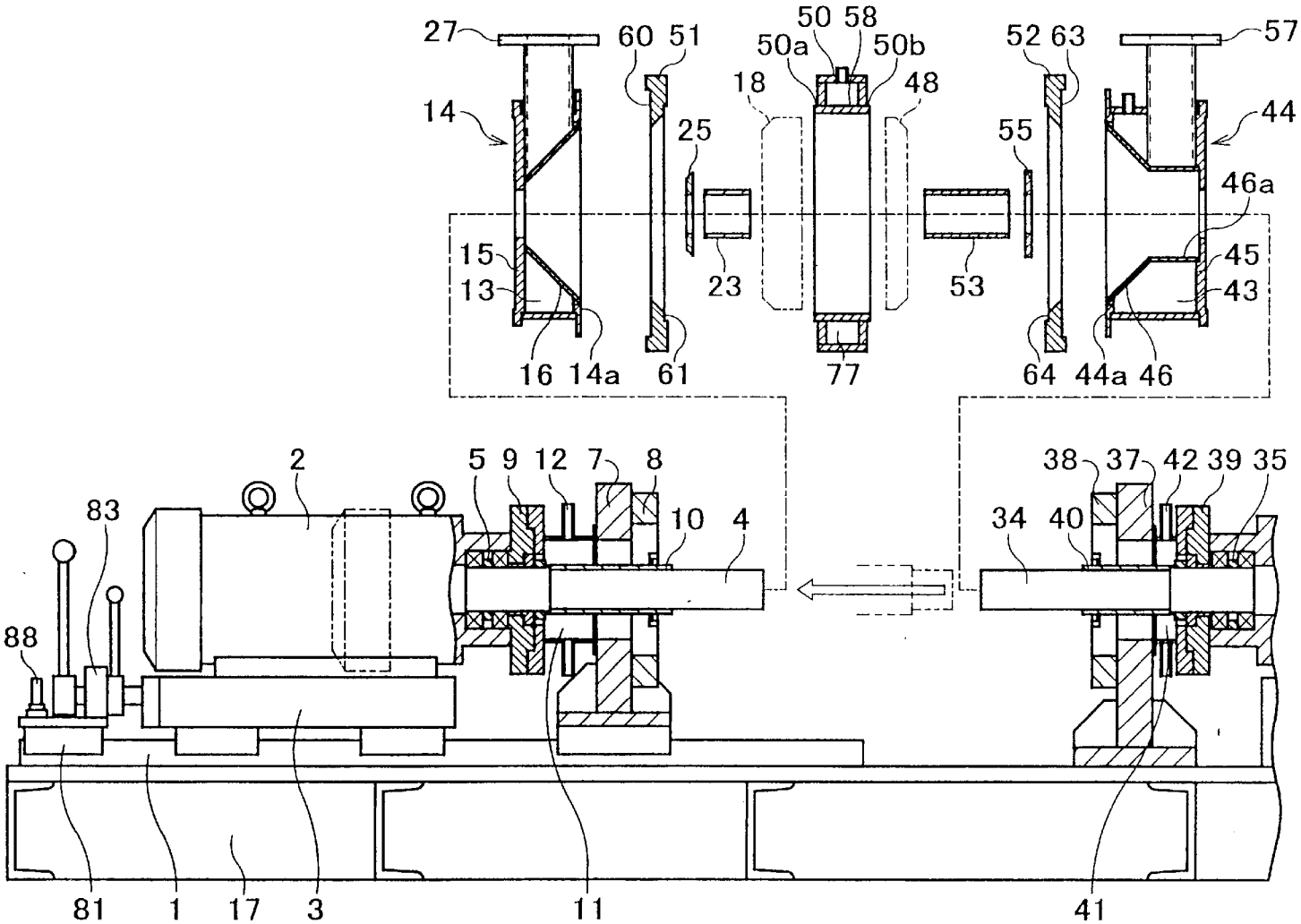
FIG. 2 is an exploded view of main portion in FIG. 1.

Movement means 100 has a rail-shaped movement guide 1 mounted on base 17 as shown in FIGS. 1A and 1B and mount 3 of motor 2 is movably mounted on this movement guide 1. Further, lock means 80 is provided at the rear of mount 3 of motor 2. Rotating shaft 4 of motor 2 is supported by shaft bearing 5 as shown in FIG. 2 and rotation wing 18 on supplying side is set to the end portion of rotating shaft 4. Spacer collar 23 and collar 10 are mounted on the outer circumference of rotating shaft 4. Also air chamber 11 is provided at the front portion of junction flange 9 and support bodies 7 and 8 movably supported by movement guide 1 are provided at the front portion of air chamber 11.

Shaft bearing 5 is protected from dust with air flushing by introducing air into air chamber 11 from supply port 12. Casing 14 on supplying side is set and fixed to the outside of collar 10 via outer case 15 in the front portion of support body 8 as shown in FIG. 4. The configuration of casing 14 on supplying side is a configuration in which a conical shaped inner case 16 is provided in the inside of outer case 15 formed in a cylindrical shape. Jacket 13 is formed between the inner case 16 and the outer case 15. The casing 14 on supplying side is cooled off by introducing a cooling medium such as a cooling liquid or cooling gas into this jacket 13.

Figure 7:
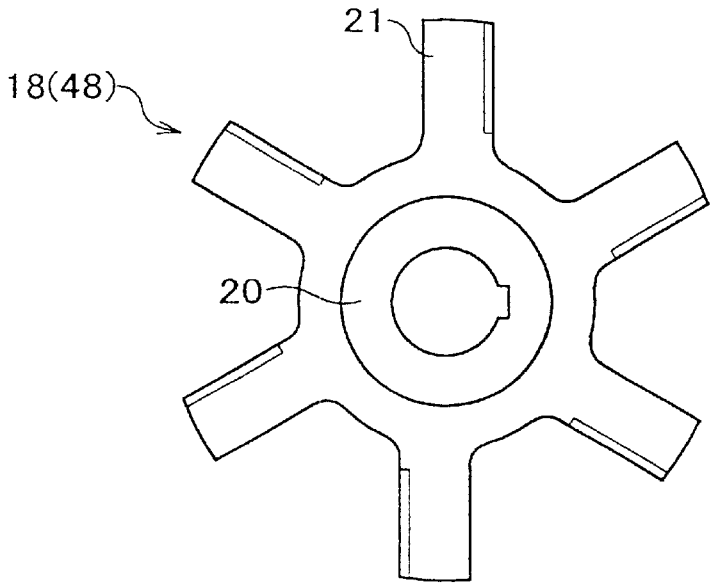
FIG. 7 is a front view of the rotation wing on the supplying side of the crusher according to the present invention.
Figure 8:
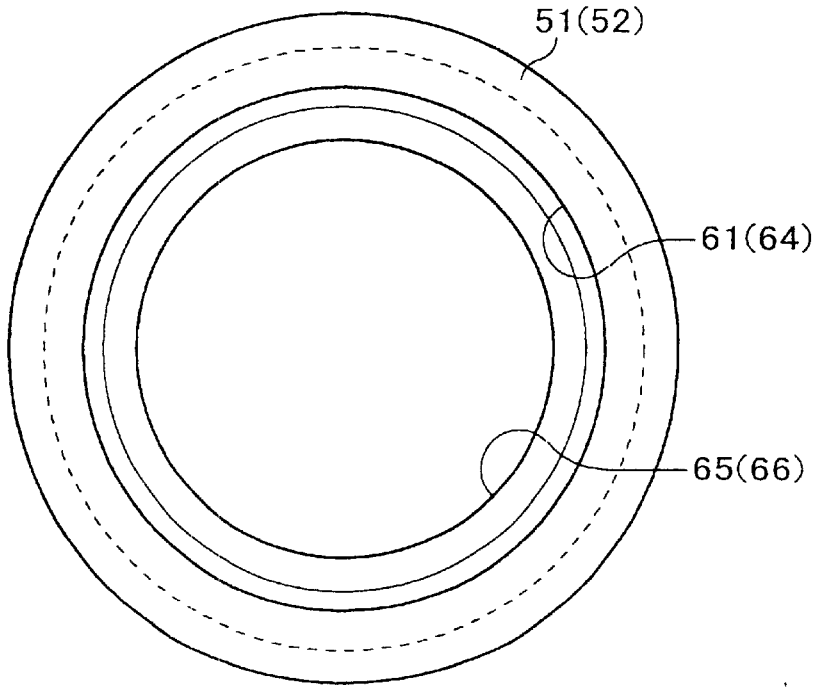
FIG. 8 is a front view of the spacer-ring of the crusher according to the present invention.

Rotation wing 18 on supplying side fixed at the tip of rotating shaft 4 is set to the front of inner case 16 as shown in FIG. 4. Rotation wing 18 on supplying side has a configuration in which radial wing portion 21 is formed on the outer circumference of a boss portion fixed to rotating shaft 4 as shown in FIGS. 7 and 4. Boss portion 20 is fitted to rotating shaft 4, it is tightened from a front portion by tightening nut 22 and the rear portion of boss portion 20 is fixed so as to press the rear portion of boss portion 20 against spacer collar 23. Seal board 25 is held between spacer collar 23 and collar 10.

Figure 6B:
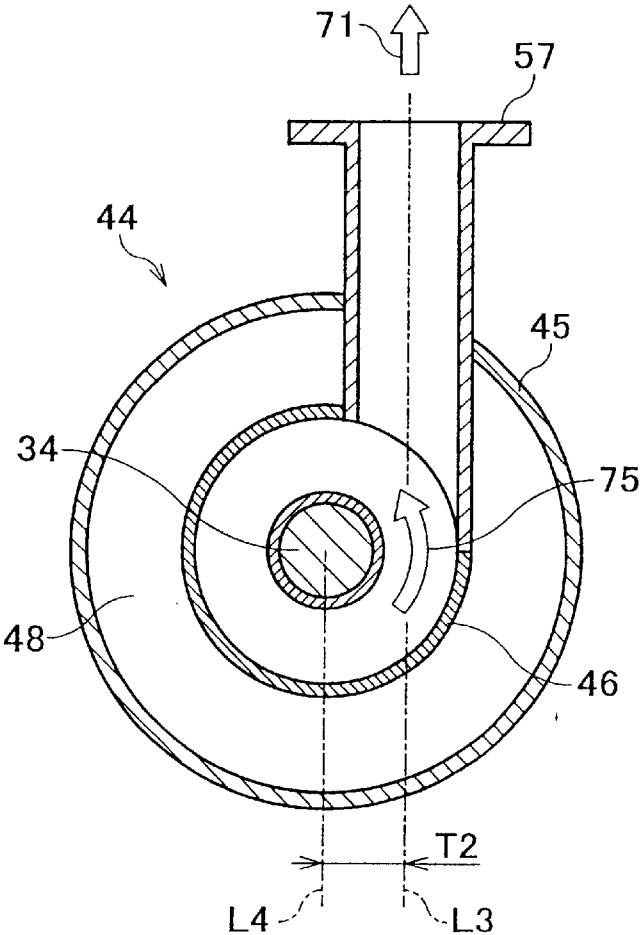
FIG. 6B is a sectional view taken along line B—B in FIG. 4.
Figure 6A:
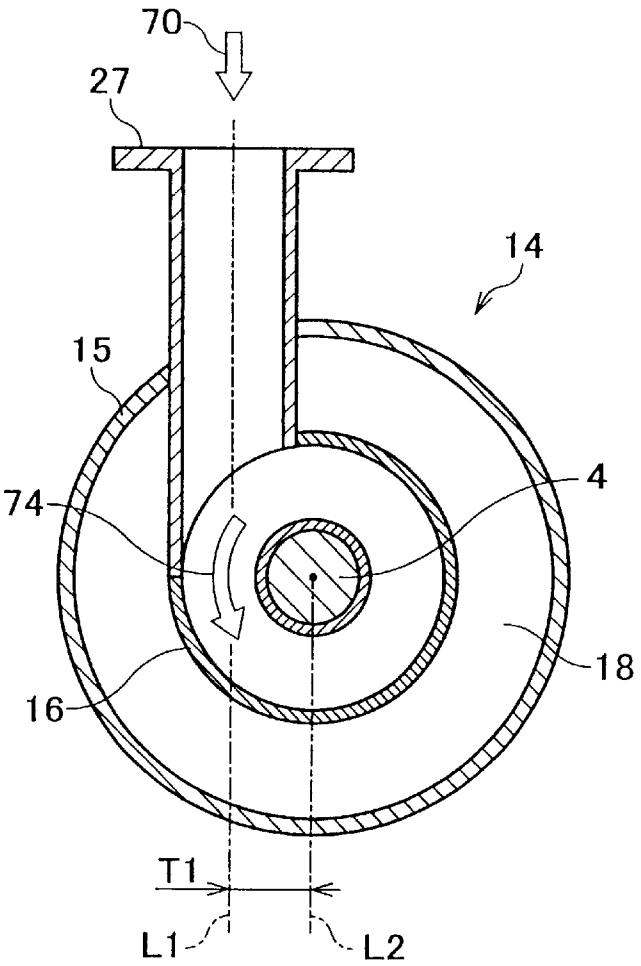
FIG. 6A is a sectional view taken along line A—A in FIG. 4.

Further, supplying inlet 27 is provided at the front of outer case 15 as shown in FIGS. 4 and 6A. The lower portion of supplying inlet 27 is connected to the upper portion of inner case 16. Supplying inlet 27 is provided such that center line L1 is located dimension T1 from rotating center L2 of rotating shaft 4. The offset of a direction 70 of supplying materials to be crushed is in the forward direction relative to the rotating direction 74 of rotation wing 18 on supplying side. That is, the center line L1 of supplying inlet 27 and rotating center L2 of rotating shaft 4 do not cross.

In FIGS. 1A, 1B and 4, casing 44 on discharge side is set to rotating shaft 34 so as to mutually face the casing 14 on supplying side. Spacer collar 53 and collar 40 are mounted on the outer circumference of rotating shaft 34. Air chamber 41 is provided at the front of junction flange 39 and support bodies 37, 38 fixed to base 17 are provided at the front portion of air chamber 41. Shaft bearing 35 is protected from dust with air flushing by introducing air into air chamber 41 from supply port 42.

Figure 3:
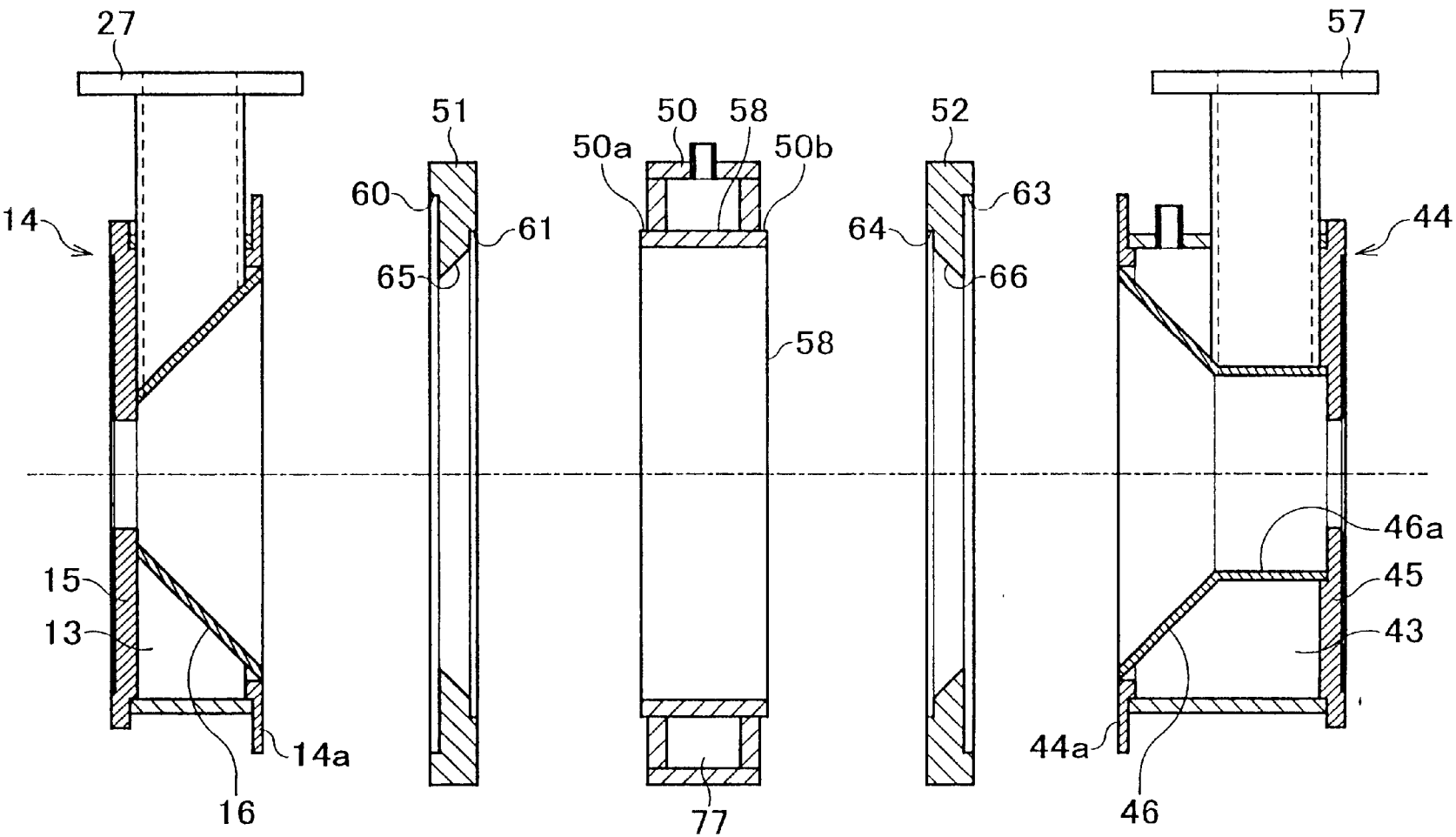
FIG. 3 is an enlarged sectional view of main portion in FIG. 2.

Casing 44 on discharge side is set and fixed to the outer circumference of collar 40 via outer case 45 and in the front portion of support body 38. As shown in FIGS. 3 and 4, the configuration of casing 44 on discharge side is a configuration in which a conical shaped inner case 46 is provided in the inside of outer case 45 formed in cylindrical shape and cylindrical guide 46*a* in cylindrical shape is provided at the tip of inner case 46. Jacket 43 is formed between inner case 46 and outer case 45. Casing 44 on discharge side is cooled by introducing a cooling medium such as a cooling liquid or cooling gas into this jacket 43.

Rotation wing 48 on discharge side fixed at the tip of the rotating shaft 34 is set to the front of the inner case 46 as shown in FIG. 4. The configuration of this rotation wing 48 on discharge side is almost the same configuration as rotation wing 18 on supplying side as shown in FIG. 7. Rotation wing 48 on discharge side is tightened from a front portion by tightening nut 54. The rear portion of boss portion 20 (Refer to FIG. 7) is fixed so as to press against spacer collar 53. Seal board 55 is held between this spacer collar 53 and collar 40.

Discharge outlet 57 is provided at the front portion of outer case 45 as shown in FIGS. 4 to 6B. The lower portion of this discharge outlet 57 is connected to the upper portion of cylindrical guide 46*a*. This discharge outlet 57 is provided such that center line L3 is located dimension T2 from rotating center L4 of rotating shaft 34 as shown in FIG. 6B. The offset of a direction 71 of discharging crushed products is in the forward direction relative to the rotating direction 75 of rotation wing 48 on discharge side. That is, center line L3 of discharge outlet 57 and rotating center L4 of rotating shaft 34 do not cross.

Note that the example in FIGS. 6A and 6B shows cases of rotation wing 18 on supplying side and rotation wing 48 on discharge side rotating in reverse directions where rotation wing 18 on supplying side faces rotation wing 48 on discharge side. In this case, the center lines L2, L3 of supplying inlet 27 and discharge outlet 57 are respectively offset from rotating centers L2, L4 by dimension T1, T2. In contrast, in a case where rotation wing 18 on supplying side and rotation wing 48 on discharge side rotate in the same direction, supplying inlet 27 and discharge outlet 57 are placed such that the direction 70 supplying of materials to be crushed and the direction 71 of discharging crushed products are in the forward direction relative to the rotating direction.

On the other hand, intermediate casing 50, and first spacer-ring 51 and second spacer-ring 52 exist between casing 14 on supplying side and casing 44 on discharge side as shown in FIGS. 1A, 1B to 4.

Jacket portion 77 is provided around the outer circumference of cylindrical portion 58 of intermediate casing 50. Crush chamber 68 is cooled by introducing a cooling medium such as cooling liquid or cooling gas from introduction inlet 59 into jacket portion 77. This intermediate casing 50 is detachably supported to base 17 via holder 55 (Refer to FIGS. 1A and 1B).

A concave portion 60, into which fits inner flange portion 14*a* of casing 14 on supplying side is formed on the outside of first spacer-ring 51. First spacer-ring 51 is a ring-shaped spacer ring. A concave portion 61, into which fits step portion 50*a* of intermediate casing 50, is formed on the inside of spacer-ring 51 (Refer to FIG. 3).

A concave portion 63, into which fits inner flange portion 44*a* of casing 44 on discharge side, is formed on the outside of second spacer-ring 52. Second spacer-ring 52 is a ring-shaped spacer ring. A concave portion 64, into which fits step portion 50*b* of intermediate casing 50, is formed on the inside (Refer to FIG. 3).

Taper surfaces 65 and 66 are respectively formed on the internal circumferences of first spacer-ring 51 and second spacer-ring 52, and taper surfaces 65 and 66 respectively face outer surfaces of rotation wing 18 on supplying side and rotation wing 48 on discharge side respectively with gaps G1 and G2 therebetween (Refer to FIG. 4).

Note that gaps G1 and G2 are very narrow and members specially placed at gaps G1 and G2 are easily worn when materials to be crushed or a crushed object is passed therethrough.

Lock means 80 to lock mount 3 of motor 2 to base 17 is provided as shown in FIGS. 1A, 1B, 5, and 9. That is, lock means 80 is placed at the rear of mount 3. Lock means 80 is configured on lock mount 81 slidable to movement guide 1, pin lever 88 is provided on this lock mount 81, screw rod 82 is fixed to mount 3 via projecting portion 83, a nut for clamp 86 and a nut for lock 87 are provided at front and rear of screw rod 82 penetrating the projecting portion 83, and clamp lever 84 and lock lever 85 control this nut for clamp 86 and nut for lock 87.

Figure 9A:
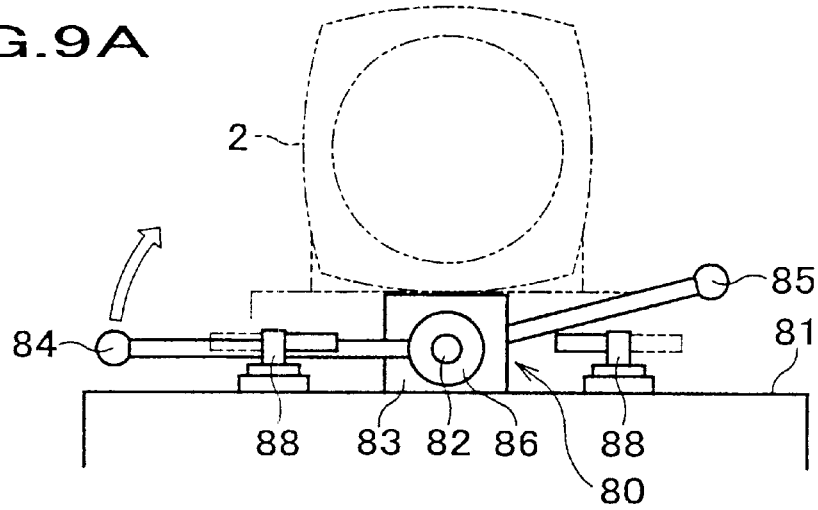
FIGS. 9A, 9B, and 9C are front views showing the operating state of the lock means in the crusher according to the present invention.

When lock means 80 is controlled, pin lever 88 of lock mount 81 is rotationally controlled from a position of virtual line to the position of continuous line as shown in FIG. 9A. Lock mount 81 is fixed to base 17 by inserting pin lever 88 in a pin hole (not shown) and locking pin lever 88 to base 17. Next, clamp lever 84 is rotationally moved in the direction of an arrow as shown in FIG. 9A and a fit portion is strongly clamped by screwing screw rod 82 tightening mount 3 as shown in FIG. 9B.

Figure 9B:
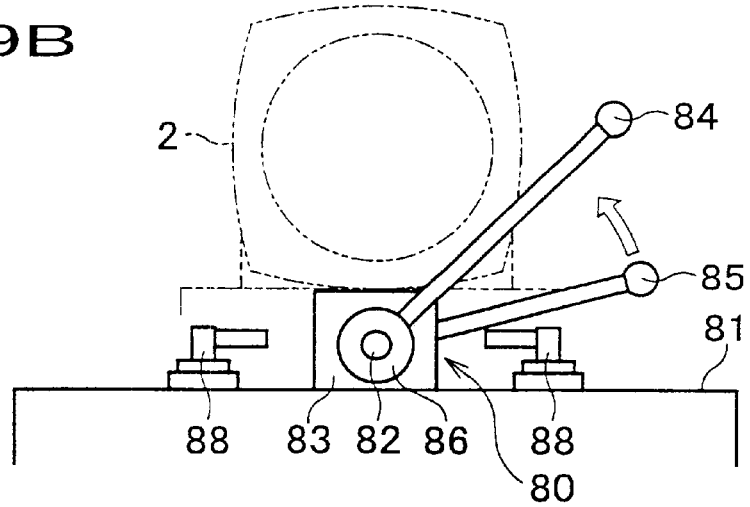
Figure 9C:
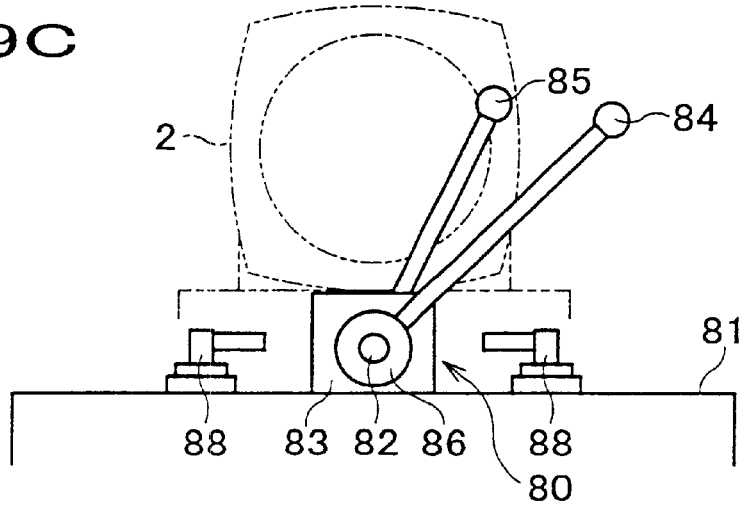

Further, lock lever 85 is rotationally moved in the direction of an arrow as shown in FIG. 9B and, lock lever 85 is strongly locked as shown in FIG. 9C not so as to undo screw rod 82. Each fit portion of casing 44 on supplying side, intermediate casing 50, and casing 44 on the discharge side are further strongly tightened and fixed by easily operating clamp lever 84 and lock lever 85 for a short time in this manner.

Next, a function is described based on the configuration of the crusher M.

FIG. 1A is a state where casing 14 on supplying side and casing 44 on discharge side fit at a position where casing 14 on supplying side and casing 44 on discharge side face each other via intermediate casing 50 and spacer-rings 51, 52. Once motor 2 is driven in this state, rotation wing 18 on supplying side is rotated in a counterclockwise. direction as in FIG. 6A (from the motor side) (in the direction of arrow 74) via rotating shaft 4. Also, once a motor on the opposite side is driven, rotation wing 48 on discharge side 48 is rotated in a counterclockwise direction as in FIG. 6B (from the motor side) (in the direction of arrow 75) via rotating shaft 34. That is, rotation wing 18 on supplying side and rotation wing 48 on discharge side are rotated in reverse with respect to one another, and circulation of air is generated in crushing chamber 68 between both rotation wings.

Once the materials to be crushed are supplied to supplying inlet 27 in this condition as shown in FIG. 4, 6 or 6B, the materials to be crushed are dropped in the direction of arrow 70, they enter into inner case 16, they pass through rotation wing 18 on supplying side, and they are absorbed in crushing chamber 68.

Since the center line L1 of supplying inlet 27 is offset from rotating center L2 of rotating shaft 4 by dimension T1, a suction created by rotation of rotation wing 18 on supplying side effectively acts on the materials to be crushed, and thereby the suction of the materials to be crushed becomes smooth and the speed to intake the materials to be crushed becomes fast.

After the materials to be crushed introduced into crushing chamber 68 are crushed by friction between each other, the crushed objects pass through conical-shaped inner case 16, and after that they pass through cylindrical-shaped cylindrical guide 46*a*, and a powdered product is discharged from discharge outlet 57 via an absorption pipe (not shown).

Further, discharge of powdered product is easy through cylindrical guide 46*a*, control of absorption is easy, and crushed product of desired grading can be obtained easily. Further, since center line L3 of discharge outlet 57 is offset from rotating center L4 of rotating shaft 4 by dimension T2, discharge force by rotating rotation wing 48 on discharge side effectively acts on the crushed product, thereby discharging the crushed smooth and the speed to discharge becomes fast.

Note that when crush working, a cooling medium is cycled in jackets 13, 43, and 77, and thereby heat caused by crush working is absorbed by jackets 13, 43, and 77 and deterioration by heat of the materials to be crushed can be suppressed to a minimum.

When conducting maintenance or inside cleaning, casing 14 on supplying side is moved from a state shown in FIG. 1A to a state shown in FIG. 1B. When making casing 14 on supplying side move, lock means 80 is operated as shown in FIGS. 9A to 9C.

That is, pin lever 88 is released from the condition of FIG. 9C, the lock lever is released so as to move from the state of FIG. 9C to FIG. 9B, and then the clamp lever is released so as to move from the state of FIG. 9B to FIG. 9A, and thereby fit portions are unlatched. Mount 3 can be moved to the rear along movement guide 1 (state of FIG. 1B). Therefore, motor 2, rotating shaft 4, and support bodies 7, 8 can also be moved and casing 14 on supplying side is moved back in the direction where casing 14 on supplying side is detached from intermediate casing 50 and casing 44 on discharge side. Therefore, the fit portions can be detached and disassembled by easy and simple operations in a short time.

Since intermediate casing 50 is fixed by fitting intermediate casing 50 to casing 14 on supplying side and casing 44 on discharge side 44, and by external pressure, it is possible to make intermediate casing 50 easily move. And although it is possible to make casing 14 on supplying side move by releasing lock means 80, casing 14 on supplying side is configured such that casing 14 on supplying side can be moved on movement rail 1 manually in the present embodiment. Of course, this movement means 100 may be configured so as to make movement means 100 also move by using driving mechanisms other than manual.

Here, since first spacer-ring 51 and second spacer-ring 52 are not held by casing 14 on supplying side, each of first spacer-ring 51 and second spacer-ring 52 can be placed in a state in which first spacer-ring 51 and second spacer-ring 52 are detached from intermediate casing 50 and can be taken off by hand. Although the intermediate casing 50 is in a state in which it is set to holder 55, the intermediate casing 50 can be separated if it is detached from this holder 55 (all of holder 55 may detached from base 17). Further, first spacer-ring 51 and second spacer-ring 52 may be configured so as to be bolted to casing 14 on supplying side and casing 44 on discharge side, respectively.

In this way, after casing 14 on supplying side, first spacer-ring 51, intermediate casing 50, second spacer-ring 52, and casing 44 on discharge side are separated and maintenance or cleaning is conducted; then opposite to the aforementioned; second spacer-ring 52, intermediate casing 50, and first spacer-ring 51 can be respectively fit to casing discharge side 44, second spacer-ring 52, and intermediate casing 50. And once mount 3 is advanced, casing 14 on supplying side is fitted to first spacer-ring 51, and then the state shown in FIG. 1A is recovered by locking casing 14 on supplying side with lock means 80.

At this time, since casing 14 on supplying side, first spacer-ring 51, intermediate casing 50, second spacer-ring 52 and casing 44 on discharge side are locked by lock means 80 in the state of fitting to each other even if there is no fixing means such as a bolt, crush working of the materials to be crushed can be conducted.

In the working mentioned above, first spacer-ring 51 and second spacer-ring 52 can be easily changed. That is, various thicknesses and materials for first spacer-ring 51 and second spacer-ring 52 are previously prepared in accordance with the materials to be crushed being processed. If first spacer-ring 51 and second spacer-ring 52 with thin thickness (thick) are used, the interval of rotation wing 18 on supplying side and rotation wing 48 on discharge side (width of crushing chamber 68) can be wide (thin).

And, in a case where the materials to be crushed are hard, first or second spacer rings 51, 52 of hard material such as that made of ceramic can be used and in a case where the materials to be crushed are soft, first or second spacer-rings 51, 52 made by usual metal can be used. Further, gaps G1 and G2 are quickly worn since the materials to be crushed or crushed product is passed through gaps G1 and G2. In a case where gaps G1 and G2 are too wide by wearing in this way, a spacer-ring can be easily changed to a new one. Therefore, gaps G1 and G2 can be changed by changing the dimension of spacer collars 23 and 53 without changing the dimension of the outer diameters of both rotation wings 18 and 48.

As mentioned above, although embodiments of this invention are described in detail, the configuration is not limited to the above embodiments and modification of design within the range of this subject matter is included in this invention. For example, supplying inlet 27 and discharge outlet 57 may be placed not at the upper portion, that is, supplying inlet 27 and discharge outlet 57 may be arranged at the position of outer cases 15 and 45, for example, at the side portion or the lower portion (in a case of discharge outlet 57) if it is configured to be capable of moving the center lines in predetermined directions from the center lines of rotating shafts 4, 34 respectively as shown in FIGS. 6A and 6B. Also the offset dimension is not limited if the center lines and the center lines of rotating shafts 4, 34 do not overlap respectively, so that the materials to be crushed can be supplied smoothly and the crushed product can be discharged smoothly.

The present invention also encompasses a configuration such that casing 14 on supplying side and casing 44 on discharge side directly fit together without using intermediate casing 50, first spacer-ring 51, and second spacer-ring 52. In that case, a projected portion is formed at a facing portion of outer cases 15 and 45 of casing 14 on supplying side and casing 44 on discharge side, and a configuration so as to fit these together is available. Or a configuration to use only one of first spacer-ring 51, second spacer-ring 52, or intermediate casing 50 or a configuration to combine two or more of them is also available.

Furthermore, casing 44 on discharge side can be configured so as to have a movement means similar to the movement means of casing 14 on supplying side. In this case, a lock means is provided on the side where a movement means is provided. Further, crush working can be conducted to change the rotating speed for each of the rotation wing on supplying side and the rotation wing on discharge side.

In the configuration of the crusher M, although one and the other motor are used to drive both rotation wings, motors are configured as a single body and the crusher M may be configured so as to place both rotation wings on the same rotating shaft.

As to the casing on the supplying side and the casing on the discharge side, each of the members may be symmetrically positioned configured with the same shaped member.

What is claimed is:

1. A crusher, comprising:

a first casing having a supply inlet where materials to be crushed are introduced, said supply inlet being on a supply side, said supply inlet having a first centerline;

a second casing having a discharge outlet where crushed product is discharged, said discharge outlet being on a discharge side, said discharge outlet having a second centerline;

a first rotation wing being on the supply side, said first rotation wing having a first rotation center and a first rotating direction about said first rotation center, said first centerline relative to said first rotation center being offset in the first rotating direction;

a second rotation wing being on the discharge side, said second rotation wing having a second rotation center and a second rotating direction about said second rotation center, said second centerline relative to said second rotation center being offset in the second rotating direction; and a crushing chamber formed between said first and second rotation wings;

wherein the materials to be crushed are supplied offset from the first rotation center and the crushed product is discharged offset from the second rotation center.

2. The crusher as set forth in claim 1, including:

a movement guide; and means for moving along said movement guide one of said first and second casings with respect to each other so that said first and second casings can be separated with respect to one another.

3. The crusher as set forth in claim 2, including lock means for fixing at a position along said movement guide one of said first and second casings.

4. The crusher as set forth in claim 1, wherein one of said first and second casings includes a detachably fitted intermediate casing.

5. The crusher as set forth in claim 4, including a spacer ring detachably fitted between said intermediate casing and at least one of said first and second casings.

6. The crusher as set forth in claim 5, wherein said spacer ring has an inner circumference, said first rotation wing has a first outer circumference facing the supply side, and said second rotation wing has a second outer circumference facing the discharge side, the inner circumference of said spacer ring facing at least one of the first and second outer circumferences of said first and second rotation wings, respectfully.

7. The crusher as set forth in claim 1, including a jacket for cooling being provided outside of said first and second casings and said crushing chamber.

8. The crusher as set forth in claim 1, including a first rotating shaft for rotating said first rotation wing on the supply side and a first spacer collar on said first shaft, said first rotation wing being in contact with said first spacer collar, said crusher further including a second rotating shaft for rotating said second rotation wing on the discharge side and a second spacer collar on said second shaft, said second rotation wing being in contact with said second spacer collar.

9. A crusher, comprising:

a first casing having a supply inlet where materials to be crushed are introduced, said supply inlet being on a supply side;

a second casing having a discharge outlet where crushed product is discharged, said discharge outlet being on a discharge side, said second casing being detachably fitted to said first casing one of said first and second casings including a detachably fitted intermediate casing;

a first rotation wing being on the supply side;

a second rotation wing being on the discharge side; and a crushing chamber formed to encompass said first and second rotation wings;

wherein said first and second casings can be detached and separated so that said crushing chamber can be maintained and cleaned.

10. The crusher as set forth in claim 9 including a spacer ring detachably fitted between said intermediate casing and at least one of said first and second casings.

11. The crusher as set forth in claim 10, wherein said spacer ring has an inner circumference, said first rotation wing has a first outer circumference facing the supply side, and said second rotation wing has a second outer circumference facing the discharge side, the inner circumference of said spacer ring facing at least one of the first and second outer circumferences of said first and second rotation wings, respectfully.

12. A crusher, comprising:

a first casing having a supply inlet where materials to be crushed are introduced, said supply inlet being on a supply side;

a second casing having a discharge outlet where crushed product is discharged, said discharge outlet being on a discharge side;

a first rotation wing on the supply side;

a second rotation wing on the discharge side; and means for detachably forming with said first and second casings a crushing chamber encompassing said first and second rotation wings.

* * * * *